US007604156B2

(12) United States Patent
Clohessy

(10) Patent No.: US 7,604,156 B2
(45) Date of Patent: Oct. 20, 2009

(54) REINFORCED FIBERBOARD BULK CONTAINER

(75) Inventor: Scott Clohessy, Spring, TX (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 916 days.

(21) Appl. No.: 10/804,209

(22) Filed: Mar. 19, 2004

(65) Prior Publication Data

US 2005/0205652 A1 Sep. 22, 2005

(51) Int. Cl.
*B65D 5/62* (2006.01)
*B65D 88/00* (2006.01)
*B65D 5/60* (2006.01)

(52) U.S. Cl. ..... 229/122.32; 206/600; 229/109; 229/122.3; 229/122.33; 229/199

(58) Field of Classification Search ..... 229/109, 229/117.35, 122.27, 122.3, 122.32, 122.33, 229/122.34, 199; 206/386, 600
See application file for complete search history.

(56) References Cited

U.S. PATENT DOCUMENTS 3,694,995 A 10/1972 McKinney
3,731,452 A 5/1973 Rias
3,852,937 A 12/1974 Bitsura et al.
4,013,168 A * 3/1977 Bamburg et al. ..... 206/386
4,177,895 A 12/1979 Shelton
4,226,327 A * 10/1980 Ballard ..... 229/122.21
4,850,506 A * 7/1989 Heaps et al. ..... 229/117.3
5,133,460 A 7/1992 Shuert
5,261,536 A * 11/1993 Wilson ..... 206/386
5,515,662 A 5/1996 Johnstone
5,772,108 A 6/1998 Ruggiere, Sr. et al.
6,012,266 A 1/2000 Koskinen et al.
6,047,523 A * 4/2000 Eyre et al. ..... 206/597
6,138,903 A * 10/2000 Baker ..... 229/122.27
6,415,927 B1 7/2002 Stone et al.
6,431,435 B1 8/2002 Jones et al.
6,588,651 B2 7/2003 Quaintance
6,834,792 B1 * 12/2004 Perkins ..... 229/109
6,932,266 B2 * 8/2005 Jones et al. ..... 229/199
2003/0024971 A1 2/2003 Jones et al.
2003/0132275 A1 * 7/2003 Ingalls ..... 229/117.3

* cited by examiner

*Primary Examiner*—Gary E Elkins
(74) *Attorney, Agent, or Firm*—Joel T. Charlton

(57) ABSTRACT

A reinforced fiberboard bulk materials container is provided that has low-fiber content and is humidity resistant. According to one embodiment, a fiberboard bulk materials container includes a plurality of fiberboard sidewalls forming a storage cavity and having a compression strength of 4 to 5 times the combined weight of cartons expected to be stacked above the bulk materials container, and a moisture-resistant polymer film wrapped around the outside of the sidewalls. The polymer film may substantially cover the sidewalls and extend from the top of the container to the bottom of the container along the sidewalls. A method for forming the bulk materials container includes stretch-wrapping the polymer film around the container sidewalls.

13 Claims, 5 Drawing Sheets

REINFORCED FIBERBOARD BULK CONTAINER

TECHNICAL FIELD

This invention relates generally to a fiberboard carton containing bulk materials. More particularly, the invention relates to a reinforced fiberboard bulk carton for shipping and storing dry-flowable bulk materials in stacked-carton configurations, and to a method for forming same.

BACKGROUND

Fiberboard containers for storing bulk products, such as dry-flowable granules, pellets, powders, flakes and the like, exist in various configurations. These containers are typically rated to contain a certain weight of product in a particular stacked configuration. For example, they may be rated to contain 1,000 pounds of product stacked three high. To adequately provide product containment and protection during product storage and shipment in the rated configuration, conventional fiberboard bulk containers are constructed of multiple layers of heavy papers combined in a laminated fiberboard construction. Typically, the compression strength of these containers for a given rating equals 5.3 to 7 times the anticipated weight stacked on top of the container. This high compression strength is needed to account for the effects of time under load (structure fatigue) and humidity (moisture strength degradation). For instance, a typical container expected to hold 1,500 lbs of product stacked three containers high would require a compression strength of approximately 17,000 to 22,400 lbs. depending on the severity of humidity and length of time in storage (including carton weight and pallet weight of about 100 pounds per container). The heavy papers of these conventional containers add significant expense to cost of the cartons.

Further, conventional cartons fail to adequately resist bulging over time due to the free-flowing nature of the bulk products contained therein. This is because dry-flowable materials stored within a carton exert an outward pressure on the carton walls that increases toward the bottom of the carton, much like hydrostatic pressure increases with depth within a fluid container. This encourages the carton walls to bulge when overstacked or upon degradation, such as from extended exposure to humidity. Conventional fiberboard cartons absorb moisture over time from humidity, which degrades the top-to-bottom compression strength of their sidewalls as well as their resistance to bending. As such, they tend to bulge over time in humid environments.

Accordingly, a need exists for a bulk materials fiberboard container that has high compression strength, resists bulging and withstands degradation due to humidity. Further, a need exists for a bulk materials fiberboard container that uses less fiberboard material than conventional containers.

Containers have been proposed for addressing one or more of these needs. U.S. Pat. No. 5,772,108 to Ruggiere, Sr. et al. (Ruggiere) discloses a corrugated paperboard container having reinforcement straps. The reinforcement straps are pre-stretched polypropylene straps placed about the girth of the carton in the flattened condition, which resist carton bulging in the erect, filled condition. The reinforcement straps permit double-wall containers to be double stacked during product storage. The reinforcement straps of Ruggiere provide concentrated reinforcement at their locations along the girth of the carton, but fail to provide reinforcement along the span of the vertical walls. Ruggiere also teaches applying a moisture-resistant coating to the paperboard to resist deterioration from water offsets. However, the moisture-resistant coating of Ruggiere is in addition to the reinforcement straps, which adds expense to the carton beyond expenses related to the cost of the reinforcement straps.

U.S. Pat. No. 5,515,662 to Johnstone (Johnstone) discloses a bulk package having a pair of reinforcing stretch film straps wrapped perpendicular to each other to form a cross pattern around a container, which is constructed of plastic film. One of the straps, which is wrapped around the top and bottom of the carton, also wraps around rigid spacer members to permit engagement with forks of a lift vehicle. Because the cartons are formed from plastic film, they lack compression strength on their own beyond the compression strength of the bulk materials stored therein.

In addition to such proposals, bundling of multiple packages together on a pallet or base is known for improving the shippabililty of the cartons. For example, U.S. Pat. No. 3,852,937 to Bitsura et al. (Bitsura) discloses a method for shrink-wrapping objects arranged on a pallet or base. In particular, Bitsura shows a method for shrink-wrapping a tubular sheet of polyethylene film around objects arranged on a base such that the sheet wraps around the base. However, the method of Bitsura does not provide reinforcement to individual cartons. It further requires the application of heat to accomplish shrink-wrapping, which adds expense and complexity to the process.

As discussed above, a need still exists for an improved bulk materials fiberboard container that has high compression strength, resists bulging, and withstands degradation due to humidity. Further, a need exists for such an improved bulk materials fiberboard container that saves cost by using less fiberboard material than conventional containers.

SUMMARY

In order to overcome the drawbacks of the prior art and/or provide an alternative arrangement, aspects of the present invention provide a low-fiber, humidity-resistant, reinforced, fiberboard bulk materials container. A bulk materials container according to one embodiment includes a plurality of fiberboard sidewalls forming a storage cavity and having a compression strength of 4 to 5 times the combined weight of cartons expected to be stacked above the bulk materials container, and a moisture-resistant polymer film wrapped around the outside of the sidewalls. According to aspects of the invention, the polymer film substantially covers the sidewalls and extends from the top of the container to the bottom of the container along the sidewalls. According to other aspects, a method for forming the bulk materials container includes stretch-wrapping the polymer film around the container sidewalls. Further aspects include stretch-wrapping multiple layers of polymer film around the container sidewalls. Other features and advantages of various aspects of the invention will become apparent with reference to the following detailed description and figures.

BRIEF DESCRIPTION OF THE DRAWINGS

The invention will be described in detail in the following description of preferred embodiments with reference to the following figures wherein.

DETAILED DESCRIPTION OF THE PREFERRED EMBODIMENTS

Figure 1:
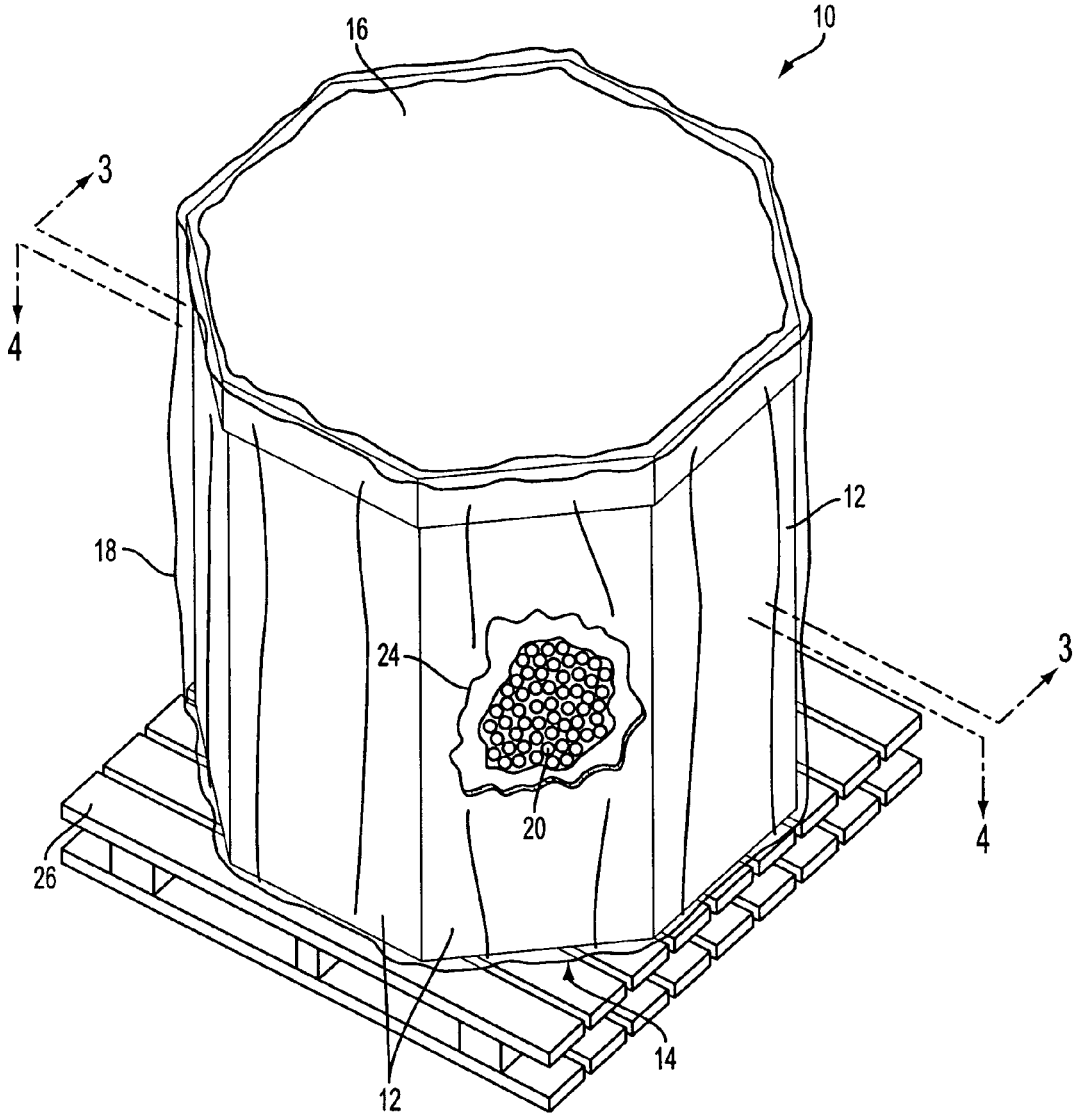
FIG. 1 is a perspective view of a reinforced, fiberboard bulk materials container according to an embodiment of the invention shown in a closed, shipping and storing configuration.
Figure 2:
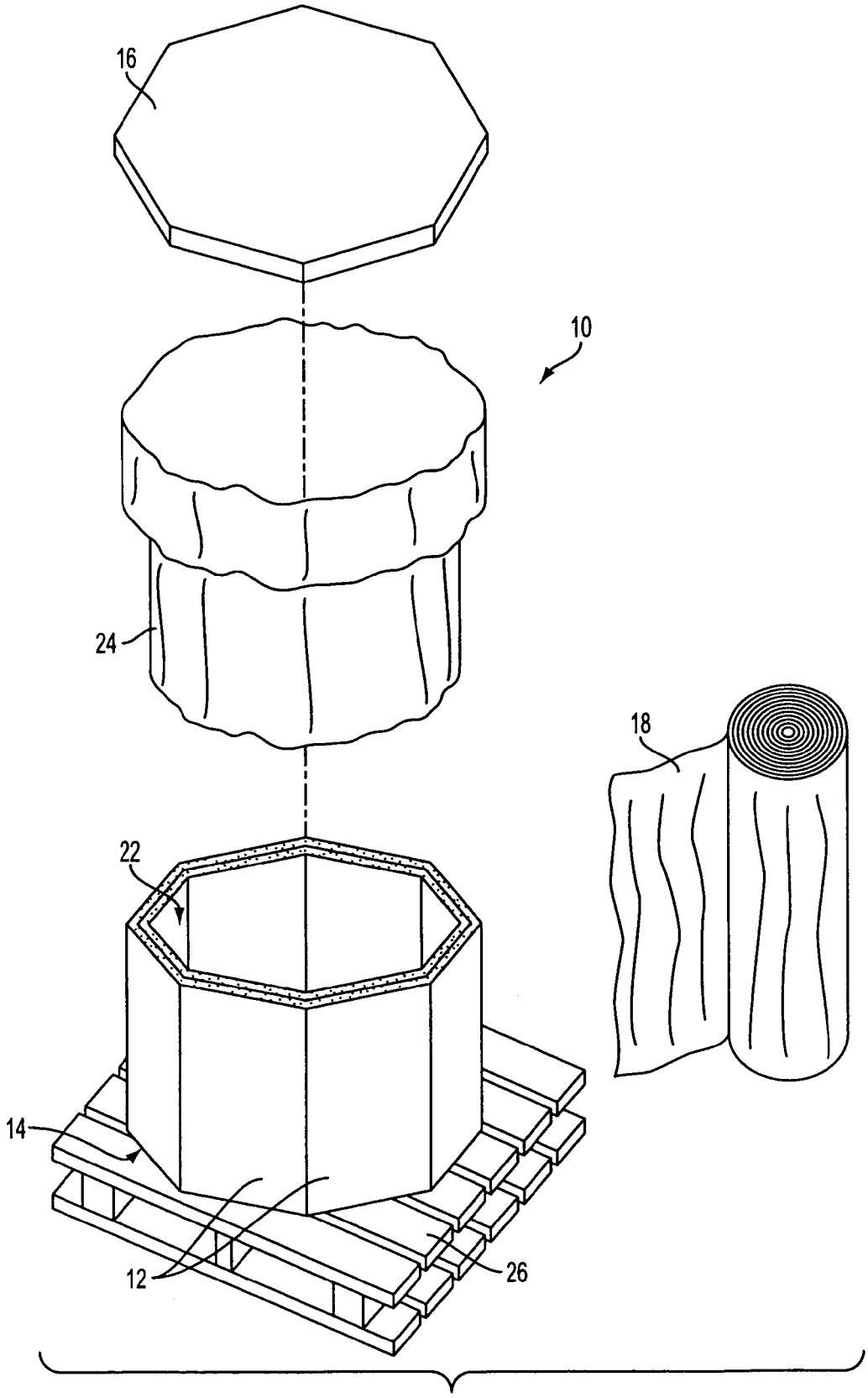
FIG. 2 is an exploded view of the carton of FIG. 1.

The various aspects of the invention may be embodied in various forms. The following description shows by way of illustration various embodiments in which aspects of the invention may be practiced. It is to be understood that other embodiments may be utilized and structural and functional modifications may be made without departing from the scope of the present invention. Referring now to FIGS. 1-6 in general and FIGS. 1 and 2 in particular, a reinforced, low-fiber, humidity-resistant, fiberboard bulk materials container 10 is shown according to an embodiment of the invention. Container 10 generally includes a plurality of sidewalls 12, a bottom 14, a top 16, a polymer film wrap 18 and dry-flowable bulk materials 20. The sidewalls 12, bottom 14 and top 16 together form a storage space 22 in which bulk materials 20 are contained. Container 10 may optionally include a bag 24 for lining the inside of container 10, which may be adapted to prevent the ingress of humidity or air as desired for particular dry-flowable materials. Container 10 may be stored on a base 26, such as a pallet, to augment transportation of the container and to provide a firm support surface. FIG. 2 shows container 10 in an exploded view without bulk materials 20.

Figure 6:
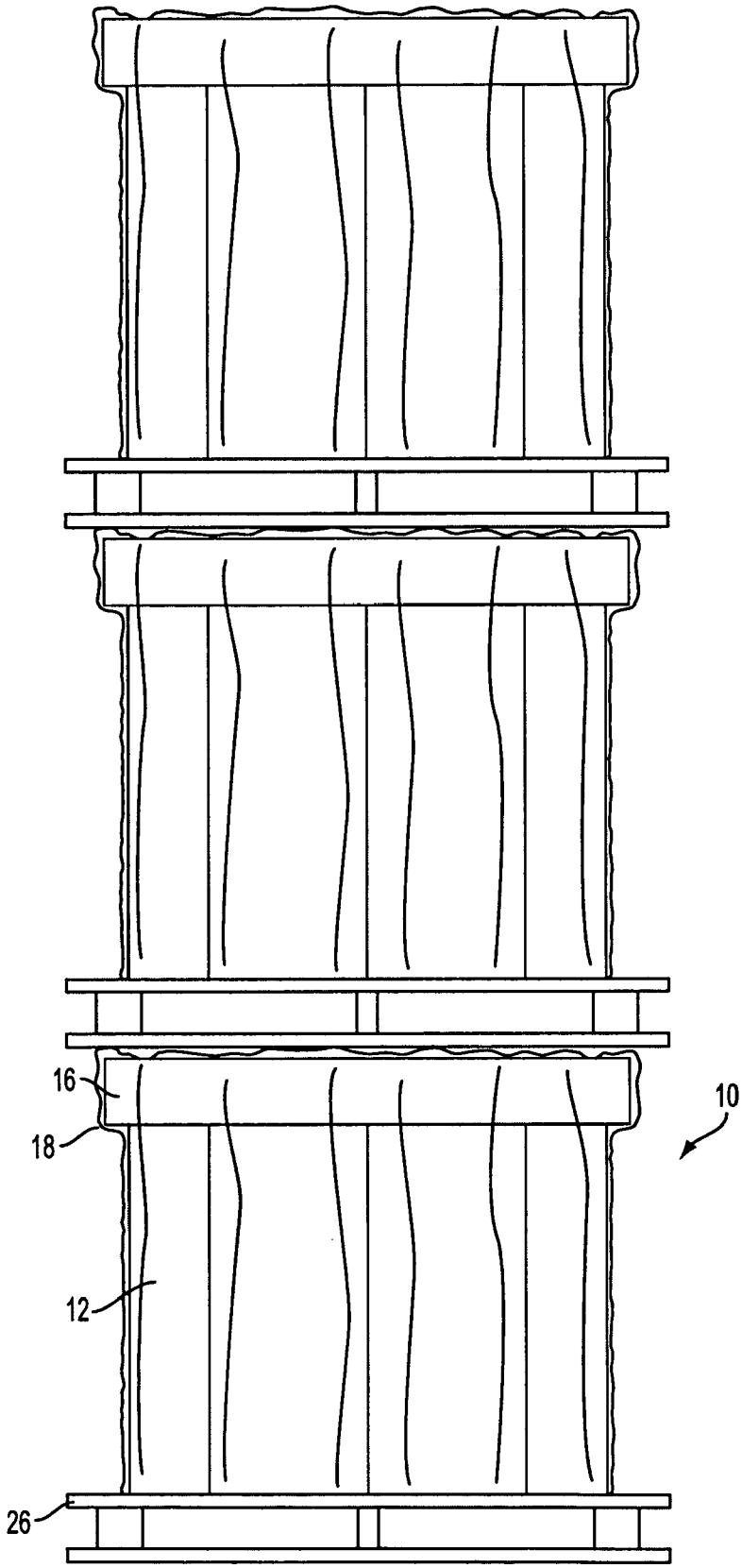
FIG. 6 is an elevational view of the carton of FIG. 1 shown in a stacked configuration with cartons of the same type.

Container 10 is adapted for shipping and storing of dry-flowable bulk materials 20, such as granular pellets, powders, flakes and the like, in a stacked configuration, such as shown in FIG. 6. For instance, container 10 may store thermoplastic granules, fertilizers, industrial chemicals, etc. Container 10 is a moderately sized container that can be efficiently stored in a stacked configuration. The polymer film wrap 18 provides reinforcing support to the sidewalls 12 of container 10, which supports the weight of additional cartons 50 and 52 stacked above container 10. It further reduces degradation of the sidewalls by inhibiting the ingress of humidity into the fiberboard sidewalls. As such, container 10 provides top-to-bottom support of additional containers 50 and 52 in vertically stacked configurations, while having lower fiber content and providing better long-term strength characteristics than similar conventional containers.

Polymer film wrap 18 is preferably formed from a linear low-density polyethylene film having a gauge of 80-120. However, a variety of polymer films may be used including other polyolefins and films of other thicknesses. Linear low density polyethylene film provides good moisture resistance properties and is relatively inexpensive compared with other polymer wraps. As such, it adds little overall cost to container 10 while reducing degradation of top-to-bottom compression strength due to humidity ingress into sidewalls 12. When tightly wound around sidewalls 12, polymer film 18 reinforces sidewalls 12 and reduces compression strength degradation over time due to fatigue and shipping stresses. For containers designed to store up to 1,000 to 2,000 pounds in stacks up to three-high, low density polyethylene film in the range of gauges from 80-120 provides sufficient structural reinforcement to fiberboard sidewalls 12 to permit a reduction in the fiberboard weight of sidewalls 12 compared with similar conventional containers (not shown).

Polymer film wrap 18 preferably includes multiple layers of polymer film applied by wrapping a single layer of polymer film multiple times around container 10; however, a single wrap may suffice. More preferably, polymer film wrap 18 includes two to three layers applied in the same manner. Two to three layers of polymer film provides enhanced protection from humidity as well as structural reinforcement compared with a single layer without significantly increasing the cost. Other options may include multiple layers of polymer film applied in one or more wraps, such as a single layer of multiply film.

Polymer film wrap 18 is preferably applied in a pre-stressed condition to enhance the degree of structural reinforcement it provides to sidewalls 12. Preferably, polymer film wrap 18 is applied with a wrap tension of about 2.5 to 7 pounds per foot of film wrap width. More preferably, polymer film wrap 18 is applied with a wrap tension of about 4 to 5 pounds per foot. Even more preferably, polymer film wrap 18 is applied with a wrap tension of about 4.5 pounds per foot. For many containers up to about 3 feet high, polymer film wrap 18 may be applied using 10 to 25 pounds of force and more preferably about 15 to 18 pounds of force. In the pre-stressed condition, the polymer film is preferably stretched about 200% to 300% from its unstretched state, and more preferably about 250% of its unstretched state. Applying polymer film 18 in a pre-stressed or pre-stretched state provides enhanced structural reinforcement to sidewalls 12 compared with unstretched polymer film. This is due to the pressure exerted inward on sidewalls 12 from stretched polymer film 18. Pre-stressed polymer film 18 also provides good moisture protection by reducing gaps between sidewalls 12 and polymer film 18 via the tighter wrap of pre-stressed film compared with unstressed polymer film. Pre-stressing the polymer film in the ranges discussed above has been found to provide good structural reinforcement and moisture protection without degrading the polymer wrap.

Figure 3:
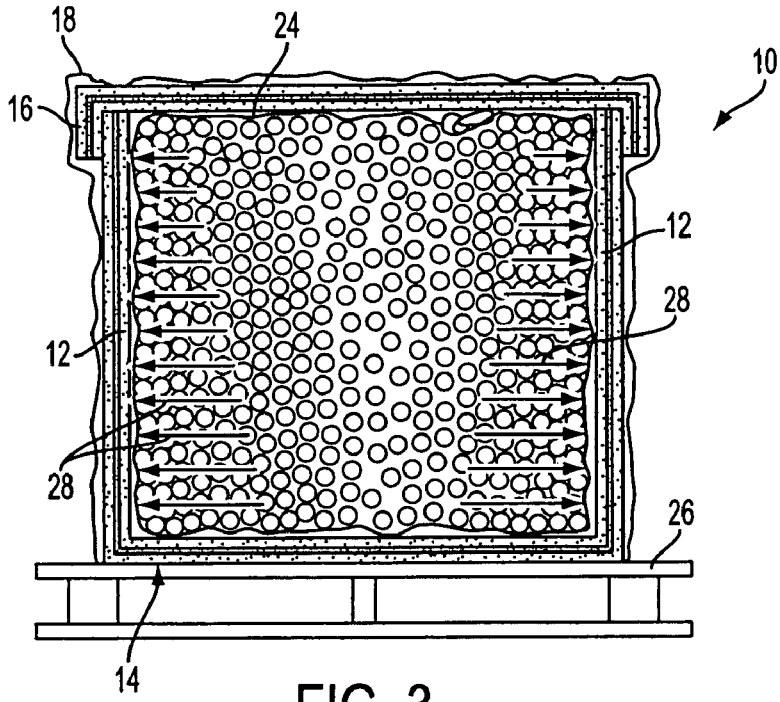
FIG. 3 is a cross-section taken through line 3-3 of FIG. 1.

FIG. 3 is an elevational, cross-sectional view of container 10. As represented by arrows 28, dry-flowable bulk materials 20 exert an outward pressure on sidewalls 12 that increases with depth, much like hydrostatic pressure increases with depth within a container holding a fluid. Polymer film 18 preferably substantially covers sidewalls 12 and extends from top 16 to bottom 14, which prevents bulging of the sidewalls due to the outward pressure from the dry-flowable bulk materials 20 and due to overstacking or degradation of the sidewalls. Tightly wrapping polymer film 18 as discussed above enhances these advantages.

Container 10 is generally a container of the type known as intermediate bulk containers or semi-bulk containers, which are typically used for storing dry-flowable materials. These types of containers are designed and rated for holding a particular weight of bulk materials stacked at a particular height. For example, a conventional semi-bulk container (not shown) may be designed and rated to hold up to 1,500 lbs of bulk materials, such as plastic granules, in a stacked configuration up to three-high. Such conventional containers (not shown) are be constructed to provide a top-to-bottom compression strength of approximately 17,000 to 22,400 lbs-force (per ASTM test method D642 and TAPPI test method T-402), taking into account about 100 additional pounds for the container and a pallet. As illustrated by this example, conventional bulk fiberboard containers are designed to have a compression strength about 5.3 to 7 times the maximum rated weight to be stacked on top of the container.

To achieve this compression strength for a conventional empty container of the present example, the fiber weight of the empty container will be approximately 35 to 40 pounds. After exposure to ambient environmental conditions such as high humidity, warehousing, shipping and time-under-load, this typical container (not shown) will provide retained top-to-bottom compression strength of approximately 6,000 to 6,500 lbs-force with which to support the static load of 3,200 lbs ((1,500 lbs plastic granules+35 lbs container+55 lbs pallet)×2) in a three-high warehouse storage. Approximately 50 to 60 percent of a fiberboard container's selling price is comprised of the fiberboard cost. As such, the high compression strength of conventional containers (not shown) adds cost in the form of heavy fiberboard.

Continuing the same example using container 10 instead of the comparable conventional container described above, costs savings are realized via the use of lighter-weight fiberboard having a lower top-to-bottom compression strength. Continuing the same example, suppose that container 10 is rated to hold up to 1,500 lbs of bulk materials. As such, container 10 may be constructed to provide top-to-bottom compression strength of approximately 12,800 to 16,000 lbs-force, which is much less than the 17,000 to 22,400 lbs-force required for a comparable conventional container. In other words, container 10 may be designed to have a compression strength about 4 to 5 times the maximum rated weight to be stacked on top of the container rather than the factors of 5.3 to 7 for a conventional container. To achieve this lower compressive strength, the fiber weight of an empty container (no product) may be approximately 22 to 24 pounds. After exposure to ambient environmental conditions such as high humidity, warehousing, shipping and time-under-load, container 10 will provide the same or better retained top-to-bottom compression strength compared with a similar conventional fiberboard container (not shown), while using less fiberboard.

The resulting performance of container 10 versus the example conventional container (not shown), which does not have polymer film wrap support, results in an overall fiber weight reduction of approximately 37 percent while providing the compressive strength needed for the rated storage requirements. Applying this cost percent to a 37 percent fiber reduction amount may result in an 18 to 22 percent cost improvement for the manufacturer or a price reduction for the customer.

Figure 4:
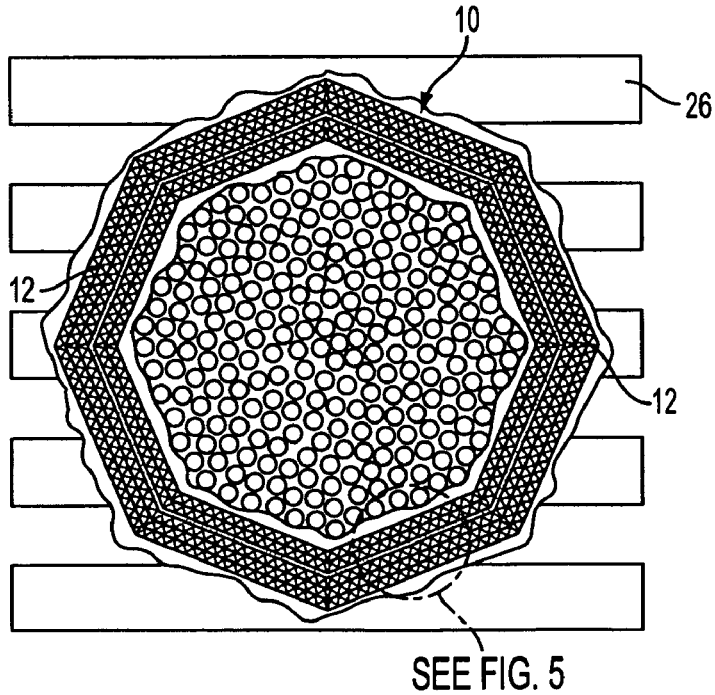
FIG. 4 is a cross-section taken through line 4-4 of FIG. 1.
Figure 5:
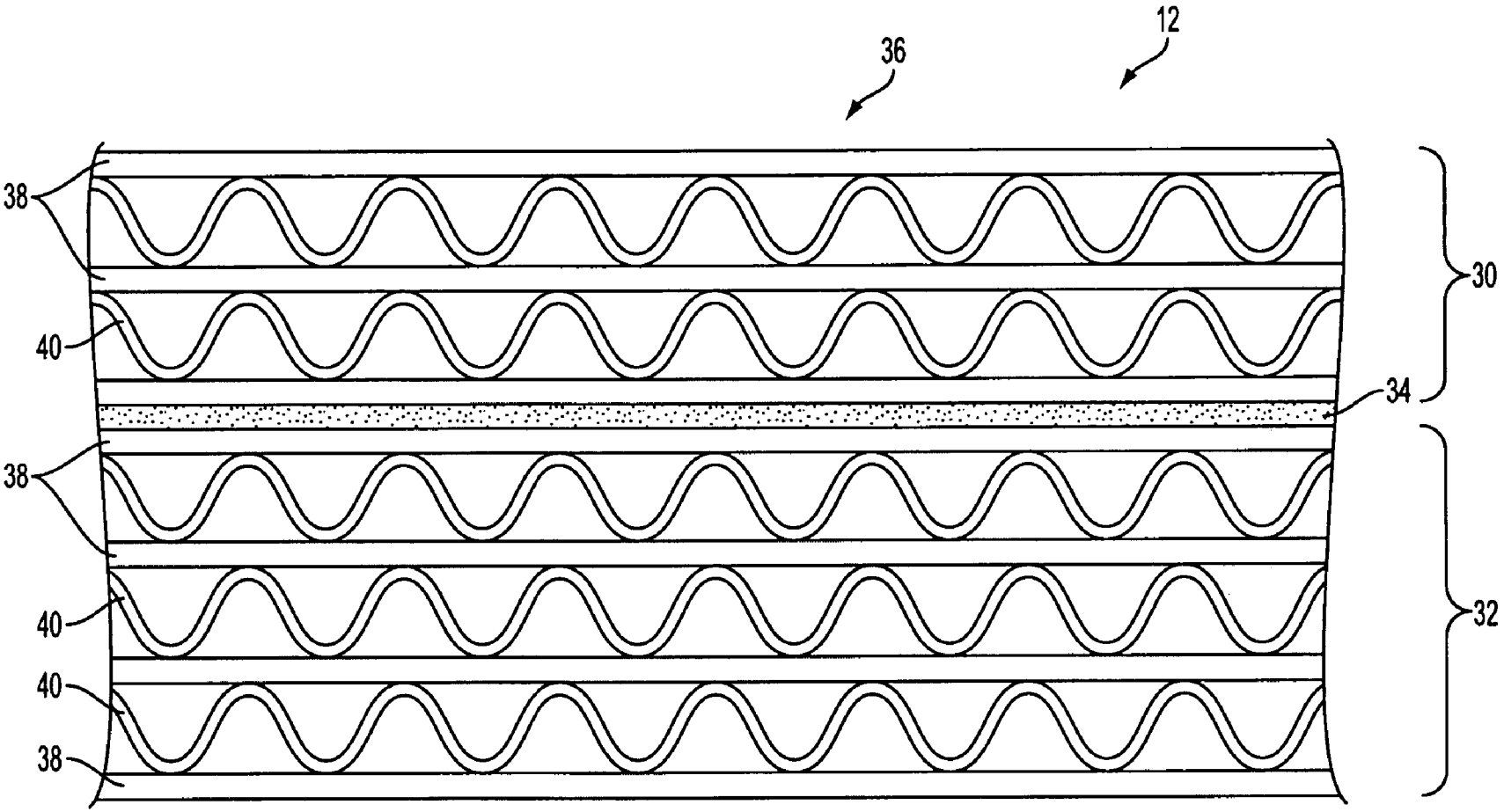
FIG. 5 is an enlarged view of a portion of the fiberboard carton wall shown in the cross-section of FIG. 4.

Sidewalls 12 are preferably made from two or more layers of corrugated fiberboard laminated together to create a high performance bulk container. As shown in FIGS. 4 and 5, sidewalls 12 of the present embodiment, as well as top 16 and bottom 14, are made from a first layer 30 of double-wall fiberboard laminated to second layer 32 of double-wall fiberboard. Layers 30 and 32 are bonded to each other via an adhesive as is known in the art, such as via a polyvinyl alcohol adhesive, to form a high strength fiberboard 36. Each layer 30, 32 includes a mixture of liners 38 and flutes 40. The flutes 40 of sidewalls 12 are substantially aligned from bottom 14 to top 16 to provide high top-to-bottom compression strength, which supports other cartons in a vertically stacked configuration. A desired top-to-bottom compression strength for fiberboard 36 may be obtained by selecting various flute designations, such as known A, B, C, E, K, F and N flute designations, and various basis weights for liners 38 and flutes 40.

As discussed above, conventional semi-bulk containers (not shown) use heavy papers to provide the necessary top-to-bottom compression strength. For instance, conventional containers (not shown) rated to store a maximum of 1,000 to 2,000 pounds of dry-flowable materials in a three-high stack would have a standard basis weight of 90, 74, 72 or 69 pounds per 1,000 square feet. Further, one or more mediums for the flutes of such a conventional container (not shown) would have a standard basis weight of 40 or 36 pounds per 1,000 square feet. These high basis weights add expense to the conventional container in order to achieve the desired top-to-bottom compression strength. Continuing the specific example mentioned above, a conventional container (not shown) rated for containing 1,500 pounds of dry-flowable bulk materials in a three-high stack would have an overall empty container fiber weight of approximately 35 to 40 pounds. In contrast, if container 10 is rated to hold a maximum of 1,500 pounds of dry-flowable bulk materials in a three-high stack, it may have an overall empty container fiber weight of approximately 22 to 24 pounds.

Continuing the same example, suppose container 10 is an octagonal container rated for shipping and storing up to 1,500 pounds of dry-flowable bulk materials, such as thermoplastics granules, in a stacked configuration up to three-high. Assume container 10 has equal sized side panels, is made of two or more layers of corrugated fiberboard, and has a cubic volume of about 50 cubic feet such as shown in FIGS. 4 and 5. Assume further that fiberboard 36 includes double wall fiberboard 30 bonded to triple wall fiberboard 32 (dw-tw) via adhesive 34. Assume also that the outermost and innermost flutes are flutes of the known C designation, and that the inner three flutes are flutes of the known A designation. As such, container 10 has an overall basis weight of about 0.54 pounds of fiber per square foot with a wall thickness of about 0.94 inches.

Comparisons of container 10 of the present example with comparable conventional containers illustrate some of the aforementioned advantages. For instance, a comparable octagonal conventional container (not shown) having equal sized panels that is rated for shipping and storing up to 1,500 pounds of dry-flowable bulk materials, and which has a cubic volume of 50 cubic feet, would be made from heavier fiberboard than container 10. Typically, the conventional fiberboard configuration would be made from double wall fiberboard bonded to triple wall fiberboard (dw-tw), or from three layers of double wall fiberboard bonded together (dw-dw-dw). For the dw-tw configuration, the outermost and innermost flutes would be flutes of the known C designation, and the inner three flutes would be flutes of the known A designation. As such, a comparable conventional container of the dw-tw configuration would have an overall basis weight of about 0.65 pounds of fiber per square foot, with a wall thickness of 0.94 inches. Further, a comparable conventional container of the dw-dw-dw configuration would have an overall basis weight of about 0.82 pounds of fiber per square foot, with a wall thickness of 1.13 inches.

A comparison of container 10 of the present example and the dw-tw configuration of a comparable conventional container (not shown) shows that the overall basis weight of container 10 is 17.58% less than the conventional container. In a comparison between container 10 and the dw-dw-dw configuration of a comparable conventional container (not shown), however, even more fiber savings is realized due to the elimination of a layer of flute material and a liner. Container 10 according to this example has an overall basis weight that is 33.88% less than a conventional container rated for the same purposes.

These basis weight savings translate into significant cost savings when using container 10 versus a similarly rated conventional container (not shown). Container 10 generally provides the same level of performance as these comparable conventional containers, but with less basis weight and cost. The basis weight savings may be greater or less for comparisons between containers according to the present invention and comparable conventional containers, such as differently sized or differently rated containers. However, the advantages of the present invention are applicable to a wide variety of container designs and types. For instance, containers according to the present invention could be rectangular, hexagonal, octagonal, etc., and may have unequally or equally sized side panels. Moreover, it is understood that such containers may be designed to be stacked in various configurations, such as four-high vertical stacks with or without the use of pallets.

Referring now to FIG. 2, a method for making container 10 is generally illustrated by the exploded view of the container. Initially, a fiberboard carton 42 is formed from a carton blank (not shown) that includes bottom 14 and sidewalls 12 that form storage space 22. A plastic liner 24 may optionally be placed into storage space 22, which is filled with dry-flowable bulk materials (not shown in FIG. 2). The carton is subsequently closed by covering storage space 22 with top 16. Polymer film 18 is then tightly wound around sidewalls 12. Preferably, polymer film 18 is also wound around side flaps 44 of top 16, and more preferably, polymer film 18 extends around side flaps 44 to the upper surface 46 of top 16. As such, polymer film 18 secures top 16 in its closed position. It further covers sidewalls 12 from top-to-bottom to reinforce the span of the sidewalls. The side flaps 44 of top 16 also act in concert with polymer film 18 to reinforce the top portions of sidewalls 12.

Polymer film wrap 18 is preferably a single layer of polymer film that is wrapped multiple times around container 10, and which is more preferably wrapped two to three times around the container. Optionally, multi-ply film may be wrapped one or more times around container 10. Multi-layer configurations provide multiple levels of reinforcing wrap support and moisture protection. Polymer film 18 is preferably pre-stretched such that it is applied under tension to sidewalls 12, which further enhances its reinforcement of the sidewalls. Preferably, polymer film wrap 18 is applied with a wrap tension of about 2.5 to 7 pounds per foot of film wrap width, and more preferably about 4 to 5 pounds per foot. For most containers up to about 3 feet high, polymer film wrap 18 may be applied using 10 to 25 pounds of force and more preferably about 15 to 18 pounds of force. In the pre-stressed condition, the polymer film is preferably stretched about 200% to 300% from its unstretched state, and more preferably about 250% of its unstretched state. Optionally, sidewalls 12 may be shrink-wrapped with a polymer film as opposed to stretch-wrapped in order to reinforce sidewalls 12 and to protect against the ingress of humidity.

While the present invention has been described in connection with the illustrated embodiments, it will be appreciated and understood that modifications may be made without departing from the true spirit and scope of the invention. In particular, the invention applies to many different cartons of various shapes, designs and applications. Additionally, it is contemplated that various polymer wraps and corrugated board configurations are applicable beyond the disclosed embodiments.

I claim:

1. A fiberboard bulk materials container rated to support the combined weight of one or more additional containers above the bulk materials container in a stacked configuration, the fiberboard bulk materials container comprising:

a top;

a bottom;

a plurality of fiberboard sidewalls connected together and attached to the top and bottom to form a storage space, the fiberboard sidewalls having a top-to-bottom compression strength of 4 to 5 times the combined weight of the additional containers;

dry-flowable bulk materials stored within the storage space; and a moisture-resistant polymer film wrapped around the outside of the sidewalls wherein the polymer film is pre-stretched 200% to 300%.

2. The fiberboard bulk materials container of claim 1, wherein the combined weight of the additional containers is 2,200 to 4,200 pounds and the top-to-bottom compression strength of the fiberboard bulk materials container is 8,800 to 21,000 pounds.

3. The fiberboard bulk materials container of claim 1, wherein the combined weight is 3,200 pounds and the top-to-bottom compression strength of the fiberboard bulk materials container is 12,800 to 16,000 pounds.

4. The fiberboard bulk materials container of claim 1, wherein the polymer film comprises a linear low-density polyethylene.

5. The fiberboard bulk materials container of claim 4, wherein the linear low-density polyethylene includes 80 to 120 gauge film.

6. The fiberboard bulk materials container of claim 1, wherein the polymer film substantially covers the sidewalls extending from the top to the bottom along the sidewalls.

7. The fiberboard bulk materials container of claim 1, wherein the polymer film includes multiple layers of polymer film.

8. The fiberboard bulk materials container of claim 7, wherein the polymer film includes 2 layers.

9. The fiberboard bulk materials container of claim 1, wherein the polymer film is pre-stretched to 250%.

10. The fiberboard bulk materials container of claim 1, wherein the fiberboard sidewalls include corrugated fiberboard having flutes oriented from top-to-bottom.

11. The fiberboard bulk materials container of claim 10, wherein the corrugated fiberboard includes double-wall fiberboard laminated to triple-wall fiberboard.

12. The fiberboard bulk materials container of claim 10, wherein each flute has a basis weight of about 33 pounds or less per 1,000 square feet.

13. A reinforced, low-fiber, humidity-resistant, corrugated fiberboard bulk materials container adapted to store 1,000 to 2,000 pounds of dry-flowable materials and rated to support a second and a third container above the bulk materials container in a stacked configuration, the second and the third container each storing 1,000 to 2,000 pounds of dry-flowable materials, the fiberboard bulk materials container comprising:

a top adapted to couple with a bottom of the second container in a vertical stack;

a bottom;

a plurality of corrugated fiberboard sidewalls foldably connected together and attached to the top and bottom to form a storage space, the corrugated fiberboard sidewalls having a compression strength of 8,800 to 21,000 pounds, the corrugated fiberboard sidewalls including flutes extending from the top to the bottom, each flute having a basis weight of about 33 pounds or less per 1,000 square feet, the corrugated fiberboard including double wall fiberboard laminated to triple wall fiberboard;

dry-flowable bulk materials stored within the storage space; and a moisture-resistant polymer film wrapped around the outside of the sidewalls and substantially covering the sidewalls extending from the top to the bottom along the sidewalls.

* * * * *